US005683784A

United States Patent [19]

Nakao et al.

[11] Patent Number: 5,683,784

[45] Date of Patent: Nov. 4, 1997

[54] INK JET RECORDING MEDIUM AND RECORD

[75] Inventors: Takuya Nakao; Isamu Takeshita, both of Yokohama, Japan

[73] Assignee: Asahi Glass Company Ltd., Tokyo, Japan

[21] Appl. No.: 534,870

[22] Filed: Sep. 27, 1995

[30] Foreign Application Priority Data

Sep. 28, 1994 [JP] Japan ..... 6-233688

[51] Int. Cl.[6] ..... B41M 5/00; B41J 5/26

[52] U.S. Cl. ..... 428/195; 428/206; 428/323; 428/328; 428/331; 428/304.4; 428/341; 428/342; 442/66; 442/68; 442/69; 442/73; 442/75

[58] Field of Search ..... 428/195, 206, 428/211, 331, 328, 323, 304.4, 341, 342; 442/66, 68, 69, 73, 75

[56] References Cited

U.S. PATENT DOCUMENTS 5,104,730 4/1992 Misuda et al. ..... 428/195

5,496,634 3/1996 Ogawa et al. ..... 428/195

FOREIGN PATENT DOCUMENTS 4 270679 9/1992 Japan .

OTHER PUBLICATIONS

Database WPI, Derwent Publications, AN-94-329640, JP-A-6 255235, Sep. 13, 1994.

Database WPI, Derwent Publications, AN-94-253440, JP-A-6 184954, Jul. 5, 1994.

*Primary Examiner*—Pamela R. Schwartz

*Attorney, Agent, or Firm*—Oblon, Spivak, McClelland, Maier & Neustadt, P.C.

[57] ABSTRACT

An ink jet recording medium comprising a substrate made of a fiber material coated with porous particles having a particle size of from 0.1 to 30 μm, and a surface layer made of boehmite as the main component, formed on the substrate.

10 Claims, No Drawings

INK JET RECORDING MEDIUM AND RECORD

The present invention relates to an ink jet recording medium, particularly an ink jet recording medium with a fabric substrate which enables formation of a high quality image by an ink jet system, and a record.

Heretofore, to dye fabrics, it has been common that various dyes or pigments are impregnated or deposited and then fixed by e.g. steam heat treatment or a chemical method. In recent years, a means such as an ink jet printer has been developed which is capable of depositing ink with high precision on a medium. However, if ink is deposited on a usual fabric by such a means, ink tends to diffuse, and a clear image can not be obtained.

It is an object of the present invention to provide an ink jet recording medium with a fabric substrate which can be printed precisely and clearly and which has weather resistance sufficient for outdoor use.

The present invention provides an ink jet recording medium comprising a substrate made of a fiber material coated with porous particles having a particle size of from 0.1 to 30 μm, and a surface layer made of boehmite as the main component, formed on the substrate.

Now, the present invention will be described in detail with reference to the preferred embodiments.

The fiber material for the substrate is not particularly limited, a cloth, knit or nonwoven fabric made of a synthetic or natural fiber may be used. Specifically, the material may, for example, be cotton, silk, hemp, wool, polyester, acrylic resin, polyamide, rayon, acetate or polyimide. Among them, polyester is preferred, since the dimensional stability is good against the temperature or humidity.

When a polyester fiber is used as the fiber material, a cloth woven with a multifilament yarn consisting of a bundle of straight and parallel fine fibers, is smooth, but has small absorptivity. A cloth woven with a processed yarn prepared by applying crimping or loop-processing to the multifilament yarn, is preferred, since the fiber alignment is disordered to form fine spaces among fibers, whereby ink absorptivity is improved. Further, a cloth or knit made of a cationic dyeable polyester which is a polyester having an acidic substituent introduced, has good adsorptivity of boehmite, whereby boehmite can be uniformly coated around the fibers. Accordingly, it is thereby possible to obtain a clear image without bleeding, as compared with usual polyester.

With a substrate having a smooth surface with a small fiber diameter, it is possible to obtain a precise glossy image. However, even with a coarse substrate, it is possible to obtain an image taking an advantage of the texture of the substrate. The fiber diameter, the fabric strength, the woven density, etc., may suitably be selected depending upon the particular use such as use for a tapestry or a flag.

The porous particles have effects of supplementing ink absorptivity during recording to a fiber material having low ink absorptivity by the fibers themselves, such as synthetic fibers. Further, they are effective to prevent ink from passing through the substrate at the time of recording, for a coarse fiber material. The porous particles are required to be particles having a particle size of from 0.1 to 30 μm. If the particle size is less than 0.1 μm, the absorptivity tends to be inadequate, such being undesirable. If the particle size exceeds 30 μm, uniform coating tends to be difficult. The porous particles preferably has an oil absorption of at least 0.1 $cm^3/g$, more preferably from 0.2 to 2.0 $cm^3/g$.

The material for the porous particles may be an inorganic or organic material. As the inorganic material, silica, clay, alumina, calcium carbonate or titanium oxide may be mentioned. As the organic material, cellulose may be mentioned. Such porous particles are preferably in a state bound by a binder. As the binder, polyvinyl alcohol, an ethylene-vinyl acetate copolymer, an acrylic resin or a urethane resin is, for example, preferred. The proportions of the porous particles and the binder are preferably such that the binder is from 5 to 300 parts by weight (dry solid content) per 100 parts by weight of the porous particles. When the porous particles are silica, and the binder is polyvinyl alcohol, it is particularly preferred that the polyvinyl alcohol is from 5 to 50 parts by weight per 100 parts by weight of the silica. When the porous particles are silica, and the binder is an acrylic resin, it is preferred that the acrylic resin is from 50 to 200 parts by weight per 100 parts by weight of the silica.

The porous particles may be present at least on one side of the fiber material. To coat the porous particles to the fiber material, it is preferred to coat the porous particles by dispersing the porous particles together with the binder in a suitable solvent. Coating is required to be carried out at a high solid content concentration and at a high viscosity. Accordingly, it is preferred to employ a coating method by means of e.g. a knife coater or a dip coater. The porous particles are preferably coated in an amount of from 1 to 40 $g/m^2$, more preferably from 5 to 20 $g/m^2$.

The surface layer made of boehmite as the main component has a function of receiving jetted ink and fixing the colorant or dye to develop it as an image. The surface layer made of boehmite as the main component may be formed on one side or on both sides. The layer preferably contains from 50 to 95 wt % of boemite. Boehmite is crystals represented by the compositional formula $Al_2O_3.nH_2O$ (n=1 to 1.5), and the surface is cationic and thus adsorbs the dye in the ink very strongly and uniformly with good dispersibility. Further, by controlling the size of the secondary aggregates of boehmite particles to a level of from 50 to 200 nm, scattering of light can be reduced, and color development of the dye will have high density and high saturation, whereby a clear image without turbidity can be obtained.

The surface layer made of boehmite as the main component is preferably in such a state that boehmite particles are bound by a binder. As the binder, an organic substance such as starch or its modified product, polyvinyl alcohol or its modified product, styrene-butadiene rubber latex, acrylonitrile-butadiene rubber latex, carboxymethyl cellulose, hydroxylmethyl cellulose, or polyvinyl pyrrolidone may, for example, be mentioned. The amount of the binder is preferably from 5 to 50 wt % of the boehmite. If the amount of the binder is less than 5 wt %, the strength of the boehmite surface layer tends to be inadequate, such being undesirable. If the amount of the binder exceeds 50 wt %, the ink absorptivity and the colorant-fixing property tend to be inadequate, such being undesirable.

The surface layer made of boehmite as the main component may be formed on the surface coated with the porous particles or on the surface not coated with the porous particles. It may be formed at least on one side, and may be formed on both sides.

The coated amount of the boehmite surface layer is preferably within a range of from 2 to 60 $g/m^2$. If the coated amount is less than 2 $g/m^2$, the colorant-fixing property and the ink absorptivity tend to be inadequate, whereby clear and high color density recording can not be obtained. If the coated amount exceeds 60 $g/m^2$, not only the material is consumed unnecessarily, but also the flexibility of the substrate tends to be impaired, such being undesirable. More preferably, the coated amount is from 4 to 30 $g/m^2$.

It is preferred to add a carboxylic acid such as malonic acid, succinic acid, adipic acid, maleic acid, oxalic acid, phthalic acid, isophthalic acid or terephthalic acid to the surface layer made of boehmite as the main component, in an amount of from 0.05 to 7.5 wt % based on the boehmite, whereby coloring caused by adsorption of e.g. a plasticizer on the boehmite layer, can be prevented.

To form the surface layer made of boehmite as the main component, on a substrate, a method may be employed wherein a coating liquid obtained by adding a binder to a boehmite sol, is coated by means of e.g. a roll coater, an air knife coater, a blade coater, a rod coater, a bar coater, a comma coater, a die coater or a gravure coater, followed by drying.

In the present invention, when a cationic resin layer is formed beneath the boehmite surface layer, the effects of adsorbing the dye can be increased, so that an image having a higher density and higher clarity can be obtained. Further, it is possible to improve the water resistance of the dye. When the boehmite surface layer is formed on both sides, it is preferred that a cationic resin layer is formed beneath each surface layer. However, the cationic resin layer may be formed only on one side.

As the cationic resin, a polyethylene imine, a polyamide resin, a polyamine resin, a reaction product of a low molecular weight polyfunctional amine with a compound polyfunctional to amino groups, such as epihalohydrin, an acrylamine copolymer resin (such as a quaternary ammonium salt polymer), a polyamide epichlorohydrin resin, or a modified product thereof, may be employed.

It is possible to improve the water resistance by using a cationic resin having a high molecular weight, such as a polyethylene imine with a molecular weight of at least 10,000. Further, by crosslinking, the water resistance can be improved. As a means for crosslinking, it is possible to employ a method of adding a thermosetting resin such as a urea resin, a melamine resin, an amide resin or an epoxy resin, to a cationic resin such as polyamine or polyethylene imine, or a method of curing by an addition of an electron beam or ultraviolet ray curable resin such as a polyester acrylate, a polyether acrylate, an epoxy acrylate or a urethane acrylate. The cationic resin layer is preferably formed by coating the porous particles on the fiber material, and then impregnating or coating a liquid having the cationic resin dissolved or dispersed in a suitable solvent. Otherwise, the cationic resin may be incorporated to the porous particles beforehand.

With a record obtained by recording on the above recording medium by an ink jet printer, if the surface is coated with a transparent or translucent resin, the weather resistance and scratch-resistance of the record can be remarkably improved. Even in a case where recording is made only on one side, the weather resistance of the record can further be improved by coating a similar resin also on the side opposite to the recorded side. In a case where the record is observed only from one side, the coating on the other side may be opaque. The coating resin is preferably hydrophobic.

Coating the surface of the record is carried out after recording. The other side may be coated after recording, but it is preferred that the other side is coated prior to recording, whereby the coating treatment can be carried out conveniently. By applying a coating on the rear side after coating the porous particles, it is possible to prevent bleeding of the resin to the printed surface.

Now, the present invention will be described in further detail with reference to Examples. However, it should be understood that the present invention is by no means restricted to such specific Examples.

EXAMPLE 1

A silica coating liquid was prepared by mixing a porous silica powder having an average particle size of 2 μm (Carplex FPX-3, tradename, manufactured by Shionogi & Co., Ltd.), a 45 wt % solution of a hydrophilic acrylic resin and water in a weight ratio of 25:100:125. This silica coating liquid was coated on one side of a polyester cloth (weight: 150 g/m$^2$, warp: 150 d, weft: 200 d) by means of a knife coater and dried. The coated amount was 15 g/m$^2$ as dry base.

A boehmite coating liquid having a total solid content concentration of 10 wt % was prepared by mixing a boehmite sol (solid content concentration: 18 wt %, dispersed particle size of boehmite: 150 nm), polyvinyl alcohol (saponification degree: 96.5%, 4% viscosity: 65 cps, MA26, tradename, manufactured by Shin-Etsu Chemical Co., Ltd.) and succinic acid in a weight ratio of 100:6:2. This boehmite coating liquid was coated on the other side of the silica-coated surface of the polyester cloth by means of a bar coater and dried at 140° C. The coated amount was 15 g/m$^2$ as dried.

EXAMPLE 2

In the same manner as in Example 1, silica was coated on a polyester cloth, and then a 5 wt % aqueous solution of a cationic resin (water-soluble polyamide resin, Sumitex Resin AR-5, tradename, manufactured by Sumitomo Chemical Co., Ltd.) was coated on the other side of the silica-coated surface by means of a bar coater. After drying, boehmite was coated on the cationic-resin-coated surface in the same manner as in Example 1.

EXAMPLE 3

In the same manner as in Example 1, silica was coated on a polyester cloth, and then a 5 wt % aqueous solution of a cationic resin (water-soluble polyamide resin, Sumitex Resin AR-5, tradename, manufactured by Sumitomo Chemical Co., Ltd.) was coated on the other side of the silica-coated surface by means of a bar coater.

On the silica-coated surface, 45 wt % solution of a hydrophobic acrylic acid was coated by means of a bar coater. To the hydrophobic acrylic resin solution, a 18 wt % aqueous solution of ammonia was added in an amount of 3 wt % to the acrylic resin, for the purpose of increasing the viscosity. After drying, boehmite was coated on the cationic-resin-coated surface in the same manner as in Example 1.

PRINTING EXAMPLE

On the recording media of Examples 1 to 3, printing was carried out with four colors of magenta, cyan, yellow and black, by means of an ink jet printer. As Comparative Example, a cloth treated up to the silica coating in Example 1, was used. The image quality was visually evaluated, and the results are shown in Table 1. In Table 1, ⊙ indicates that the image quality is excellent, ○ indicates that the image quality is good, Δ indicates that the image quality is fair, and x indicates that the image quality is poor. Comparative Example presented a whitish image quality with color fading. Then, for evaluation of water resistance, the recording medium after printing was immersed in water for 4 hours, whereby bleeding of magenta was visually observed and relatively evaluated in a similar manner. Further, the color density was measured before and after the immersion, to obtain the ratio of the color density after immersion to the color density before immersion.

EXAMPLE 4

After printing, a 5 wt % solution of polyvinyl butyral (isopropanol solvent) was coated on the printed surface to form a protective film of 10 g/m$^2$. With respect to this coated product, similar evaluation was carried out, and the results are shown in Table 1.

TABLE 1

| | Image quality | Water resistance | Color density change |
|---|---|---|---|
| Example 1 | ○ | ○ | 95% |
| Example 2 | ◎ | ◎ | 100% |
| Example 3 | ◎ | ◎ | 100% |
| Example 4 | ◎ | ◎ | 100% |
| Comparative Example 1 | X | X | 30% |

With the ink jet recording medium of the present invention, a clear color image can easily be prepared by an ink jet printer, and an output of an image on a large area is also easy. Further, the durability of the image is high. The record by this recording medium can be used for an advertising sign, a flag or a tapestry. When a coating layer is formed after printing, a record having particularly high durability can be obtained, which is sufficiently durable for use outdoors for a long period of time.

What is claimed is:

1. An ink jet recording medium comprising a substrate made of a cloth coated on one side with a layer consisting essentially of porous particles having a particle size of from 0.1 to 30 μm and a binder, and a surface layer consisting essentially of boehmite in an amount of at least 50 wt % and a binder, formed on the other side of the substrate wherein said layer is different from said surface layer.

2. The ink jet recording medium according to claim 1, wherein the porous particles are silica.

3. The ink jet recording medium according to claim 1, wherein the amount of the porous particles coated is from 1 to 40 g/m$^2$.

4. The ink jet recording medium according to claim 1, wherein the cloth is a polyester fabric or knit.

5. The ink jet recording medium according to claim 1, which has a cationic resin layer beneath the surface layer made of boehmite.

6. A record obtained by recording on a surface layer made of boehmite of an ink jet recording medium comprising a substrate made of a cloth coated on one side with a layer consisting essentially of porous particles having a particle size of from 0.1 to 30 μm and a binder, and the surface layer consisting essentially of boehmite in an amount of at least 50 wt % and a binder, formed on the other side of the substrate, by an ink jet printer wherein said layer is different from said surface layer.

7. The record according to claim 6, wherein the porous particles are silica.

8. The record according to claim 6, wherein the amount of the porous particles coated, is from 1 to 40 g/m$^2$.

9. The record according to claim 6, wherein the cloth is a polyester fabric or knit.

10. The record according to claim 6, which has a cationic resin layer beneath the surface layer made of boehmite.

* * * * *